United States Patent [19]

Bossler et al.

[11] Patent Number: 4,470,741

[45] Date of Patent: Sep. 11, 1984

[54] PRESS UNLOADING INSTALLATION

[75] Inventors: Friedrich Bossler, Weiterstadt; Gerhard Melzer, Lautertal, both of Fed. Rep. of Germany

[73] Assignee: Carl Schenck AG., Fed. Rep. of Germany

[21] Appl. No.: 356,860

[22] Filed: Mar. 10, 1982

[30] Foreign Application Priority Data

May 20, 1981 [EP] European Pat. Off. ..... 81103862.9

[51] Int. Cl.[3] ..... B65H 29/00

[52] U.S. Cl. ..... 414/280; 414/285; 414/286; 198/472; 100/196; 425/403.1

[58] Field of Search ..... 414/280, 285, 286; 100/196; 198/472; 425/403.1, 440, 89

[56] References Cited

U.S. PATENT DOCUMENTS

| | | | |
|---|---|---|---|
| 2,732,085 | 1/1956 | Siempelkamp | 414/286 |
| 2,897,772 | 8/1959 | Hunter | 425/89 X |
| 2,907,479 | 10/1959 | Cunningham | 414/280 X |
| 3,372,217 | 3/1968 | Paerels et al. | 414/280 X |
| 3,542,629 | 11/1970 | Burkner | 156/558 |
| 4,065,003 | 12/1977 | Hostettler | 414/277 |
| 4,204,820 | 5/1980 | Toncelli | 425/89 |
| 4,277,216 | 7/1981 | Lindberg | 414/285 X |
| 4,324,326 | 4/1982 | Khoylian et al. | 198/472 X |
| 4,362,452 | 12/1982 | Sparr | 198/472 X |
| 4,405,277 | 9/1983 | Burkner et al. | 414/222 |

FOREIGN PATENT DOCUMENTS

| | | | |
|---|---|---|---|
| 1653319 | 9/1971 | Fed. Rep. of Germany . | |
| 1460480 | 11/1966 | France | 100/196 |

*Primary Examiner*—Robert J. Spar
*Assistant Examiner*—Ken Muncy
*Attorney, Agent, or Firm*—Connolly and Hutz

[57] ABSTRACT

Simultaneous removal from a multi-level press of all press trays carrying particle board panels is achieved with a press unloading installation. Such installation consists of a vertically movable press unloader cage having chain conveyor pairs, primary supports for the press trays and panels, and auxiliary supports for the trays alone after separation from the panels. The installation further includes a discharge device for removing the press trays from the auxiliary supports of the unloader cage. In order to shorten the return transport of flexible press trays, separation between the finished pressed particle board panels and the flexible press trays is accomplished in the press unloader cage.

6 Claims, 4 Drawing Figures

2
30
4
6
11
13
15
12
3
4
5
16
20
9
18
32
25
24
23

PRESS UNLOADING INSTALLATION

BACKGROUND OF THE INVENTION

The present invention concerns a press unloading installation consisting of a vertically moving press unloader cage with chain conveyors and supports for the press trays and panels being removed from a multi-level press, and a discharge device for removing the press trays from the container after the panels have been separated from the trays.

Press unloading installations are located behind multi-level presses in order to facilitate the fastest possible removal of panel products from these multi-level presses and to continuously operate the further transportation of particle board panels produced in the press. At the present time, the finished particle boards are discharged together with the press trays from the press into a press unloader cage and are then subsequently transported to a separation station installed behind the press unloader cage, at which station the finished pressed particle board panels are separated from the press trays. Thereafter, in the case of flexible press trays, the flexible press trays are transported, after the separation, via a downward conveyor to a return conveyor, which returns the empty press trays to the feed station (German Offenlegungsschrift No. 1653319). In small installations, this system for press unloading and product separation causes significant expenditures, which are clearly reflected in the length of the installation as well as in the price of machinery.

SUMMARY OF THE INVENTION

In order to eliminate the above disadvantages, the problem to be solved by means of the invention is that of using a press unloader cage for a double purpose, namely as a separation device to remove the pressed particle board panels from their flexible press trays and, at the same time, as a conveyor for the empty flexible press trays. According to the invention, this problem is solved by providing a cage, open in a vertical direction, by providing the chain conveyor pair of each level with carriers which catch the head ends of the flexible press trays, and by providing a discharge device in the central open area of the cage for removing the flexible press trays after they have been separated from the finished pressed particle board panels. This solution, according to the invention, totally eliminates an additional separation station, a downward conveyor, and a conveyor to the return transport for flexible press trays, all of which were unconditional requirements according to the state of the present technology.

One embodiment of the object of this invention has a U-shaped unloader cage open at the bottom, and a discharge device for the flexible press trays which is located below the cage in the area of the central opening therein. This arrangement makes it possible to attach the discharge device directly to a base, and the U-shaped cage can then be moved up and down relative to the discharge device.

In another embodiment of the invention, it is suggested that a drum-like sheathing be provided in that area where the chain conveyor changes direction. This sheathing primarily facilitates clean transportation of the flexible press trays after separation from the particle boards.

In yet another embodiment, it is suggested that guides be placed in that area where the chain conveyor changes direction. The application of such guides guarantees a safe turn of the press trays so that, in case of a rapid upward movement, the free end of the press tray would not destroy the particle board which is being discharged.

As another variation of the objects of this invention it is suggested that at least the lowest chain conveyor pair be provided with an auxiliary deck in the area of its return. The auxiliary deck arrangement has a significant effect, namely that the head ends of the flexible press trays are appropriately positioned for being accepted onto the discharge device.

In order that the particle board panels that have been separated from the flexible press trays be appropriately positioned for removal, one execution of the object of the invention is considered to consist of an arrangement of pressure rollers with a live roller conveyor behind the separation station. The utilization of pressure rollers rotating at adjustable speed makes it possible to keep the removal transportation of the finished pressed particle board panels continuous in spite of discontinuous evacuation and separation.

BRIEF DESCRIPTION OF THE DRAWING

Novel features and advantages of the present invention in addition to those mentioned above will become apparent to those skilled in the art from a reading of the following detailed description in conjunction with the accompanying drawing wherein similar reference characters refer to similar parts and wherein.

DETAILED DESCRIPTION OF THE INVENTION

Figure 1:
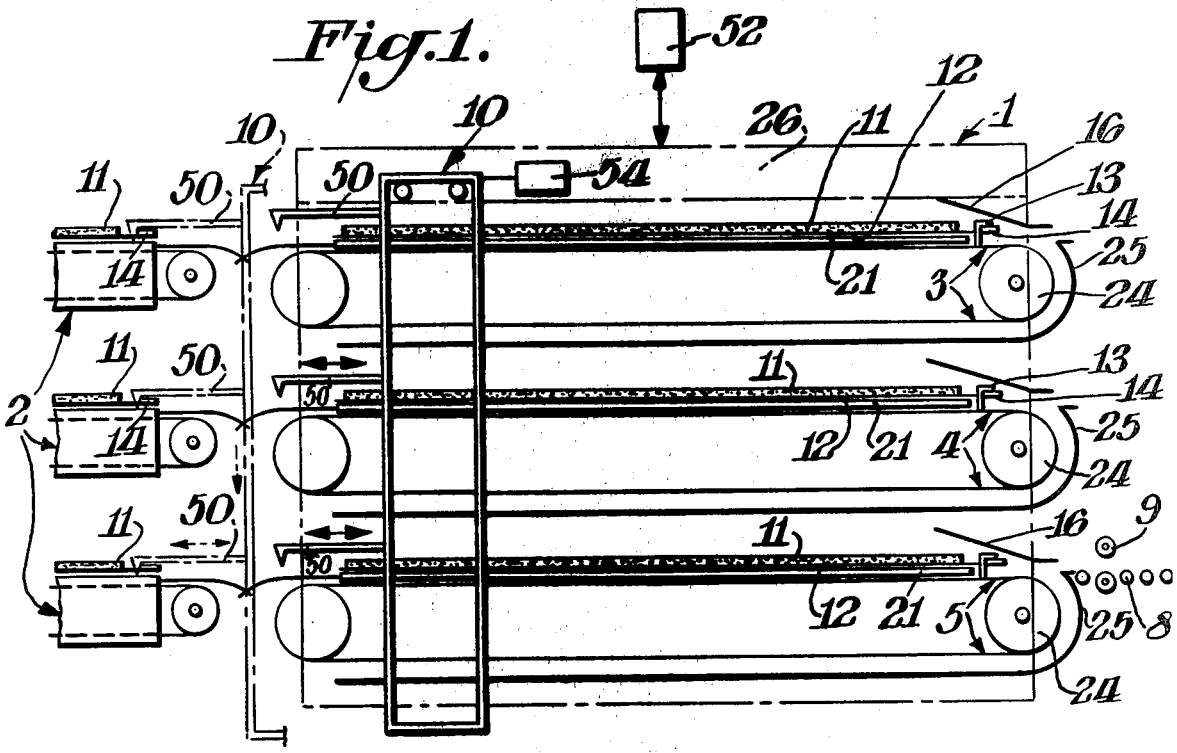
FIG. 1 is a schematic side elevational view of a press unloading installation for removing sheet material from a press and discharging the press trays, according to the present invention.
Figure 1:
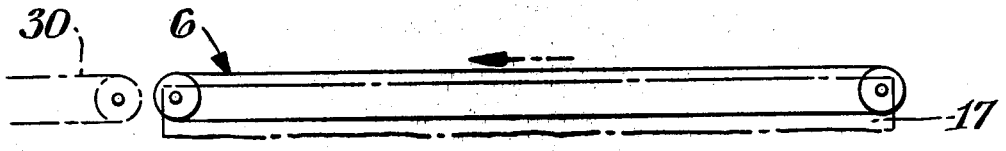

A press unloading installation consists of a press unloader cage 1 including chain conveyor pairs 3, 4, and 5. The installation also includes a discharge device 6 located between a schematically represented three-level press 2 and a live roller conveyor 8 having at least one pair of pressure rollers 9.

Figure 2:
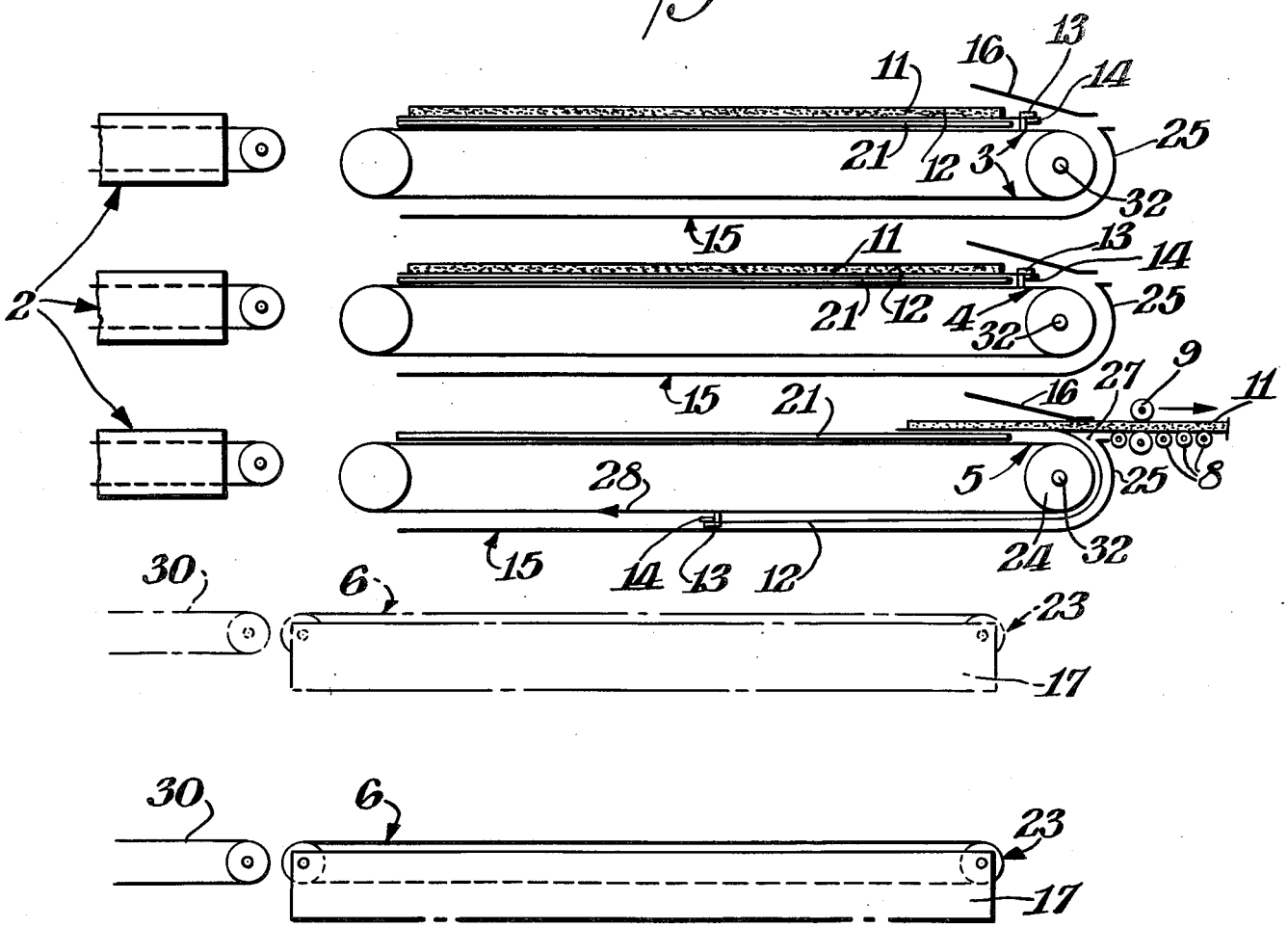
FIG. 2 is a schematic side elevational view of the installation of FIG. 1 in another position of the operational sequence and also showing in phantom outline a second embodiment of the device for discharging the press trays.

The press unloader cage 1 also has a feeder 10 which is only shown in FIG. 1 for the sake of clarity. The feeder 10 functions to horizontally transfer finished pressed particle board panels 11 together with their respective flexible press trays 12 from the three-level press 2 into the action area of the chain conveyor pairs 3, 4, and 5. The chain conveyor pairs 3, 4, and 5, are each provided with carriers 13 for catching the flexible press trays 12 directly behind head ends 14 at the front of the trays. By means of these chain conveyor pairs and the carriers 13, all flexible press trays 12 and the particle board panels 11 resting on them are removed simultaneously from the three-level press 2. After all of the chain conveyor pairs—which are also considered as constituting three levels of the press unloader cage 1—are loaded with flexible press trays 12 carrying particle board panels 11, the procedure shown in FIG. 2 is performed, namely a removal of each panel from the cage 1 and a simultaneous separation of each panel from its associated flexible press tray 12.

As shown best in FIG. 1, the feeder device 10 includes three pairs of horizontal arms 50 with each pair in alignment with one of the three levels of the press 2. Each arm has a hook-shaped outer end for attachment to the head ends 14 of the flexible press trays 12. The head ends of the press trays extend outwardly from each side of the tray at the front end portion thereof. In operation, the feeder device 10 is connected to the cage frame for movement in a vertical direction with the frame. A suitable elevator device 52 is provided for this purpose. Additionally, the device 10 is mounted to the cage frame for horizontal movement relative to the frame by a roller arrangement, for example, or other convenient means. A motivator 54 is provided to shift the feeder to the right or left relative to the frame of the cage 1.

In transferring the panels and their respective trays from the press to the conveyor pairs on the cage, the feeder device 10 is slightly upwardly shifted via the elevator 52 and then shifted to the left via motivator 54. Slight downward movement of the feeder device positions the hooked ends of the arms 50 (as shown in phantom outline) behind the head ends 14 of the flexible press trays 12. Subsequent shifting of the feeder device 10 to the right as shown in FIG. 1 brings the trays into engagement with the three conveyors of the cage 1. The carriers 13 then engage the head ends 14 of the trays whereby the panels and trays move into the cage on the conveyors.

Each horizontally spaced apart conveyor pair is associated with an upper support deck 21 in horizontal alignment with the upper reach of the conveyor. As shown best in FIG. 4, the support decks 21 are also horizontally spaced apart in the same manner as the conveyor pairs to provide an open central portion 19 in the container, as explained more fully below.

Figure 4:
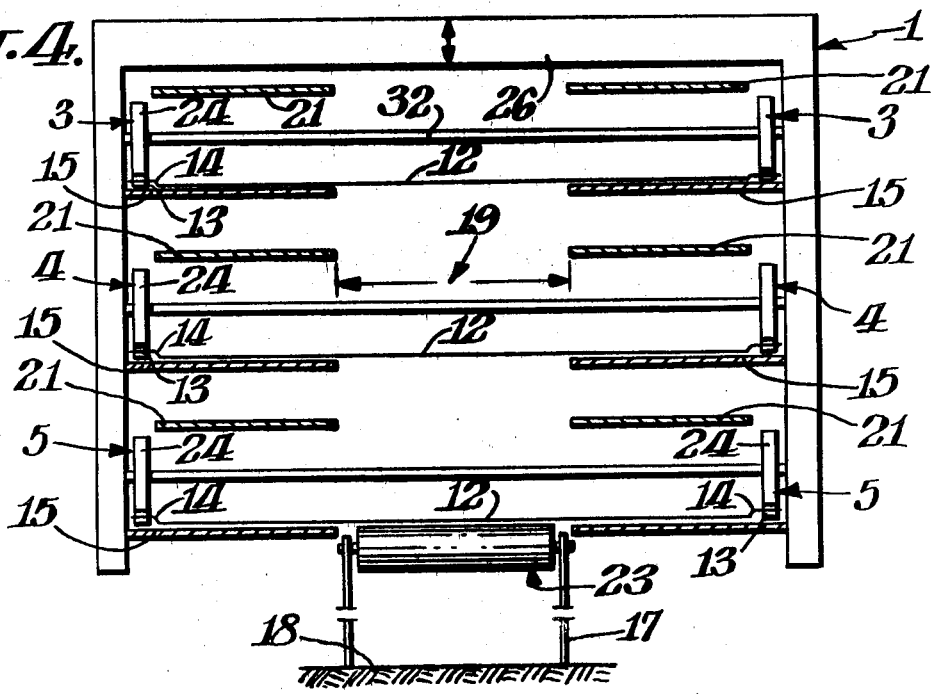
FIG. 4 is an end elevational view in cross-section taken along line 4—4 of FIG. 3.

The support decks 21 serve as supports for the flexible press trays loaded with the particle board panels 11. As shown in FIG. 2, when the chain conveyor pair 5 is activated by means of a motor (not shown) the lowermost panel 11 is removed by the roller conveyor 8 and the pressure rollers 9. Simultaneous separation of the tray 12 from the panel also occurs at this station. The head pieces 14 of the flexible press tray 12 are transported around the drive chain sprockets 24 by the carriers 13 located on the chain conveyor pair 5. The area between the chain conveyors 5 to the left and to the right of the press unloader cage 1 is provided with a drum-like sheathing 25 which on the one hand protects the connection and drive shafts of the drive chain sprockets 24, and on the other hand, serves as a guide path for the flexible press trays 12. In the area of the directional change 27, the particle board panel 11 and the flexible press tray 12 are thus forced to separate, as shown in FIG. 2. The particle board panel 11 is removed by pressure rollers 9 and fed to the roller conveyor 8 for further processing. By means of the return direction 28 of the chain conveyor pair 5, the flexible press tray 12 is transported to an auxiliary deck 15, and deposited there. The drive for the chain conveyor pair 5 is then stopped. The auxiliary decks are similar in size and relationship to one another in the same manner as support deck pairs 21, as best shown in FIG. 4. Each auxiliary deck pair is horizontally spaced apart and in vertical alignment with the lower reach of the conveyor.

When the lowest level of the press unloader cage has been emptied in this manner and there has been a simultaneous separation of the flexible press tray 12 from the particle board panel 11, the press unloader cage 1 is lowered one level so that chain conveyor pair 4 can complete the unloading and separation of particle board panel 11 and flexible press tray 12 on the next level, in the same manner as described above for the lowest level. In this regard the cage is lowered via the motivator 52 until the middle conveyor pair 4 is in alignment with the roller conveyor 8, and the removal procedure is repeated. The cage is lowered again until the upper conveyor pair 3 is in alignment with the roller conveyor 8, as shown in FIG. 3, and the panel thereon is then removed, as described above.

Guides 16 have been provided at each level in order to prevent the trailing end 20 of the flexible press tray 12 from whipping upwardly after separation from the particle board panel 11. The end 20 shown in phantom line in FIG. 3 is not caught by the head piece 14.

Figure 3:
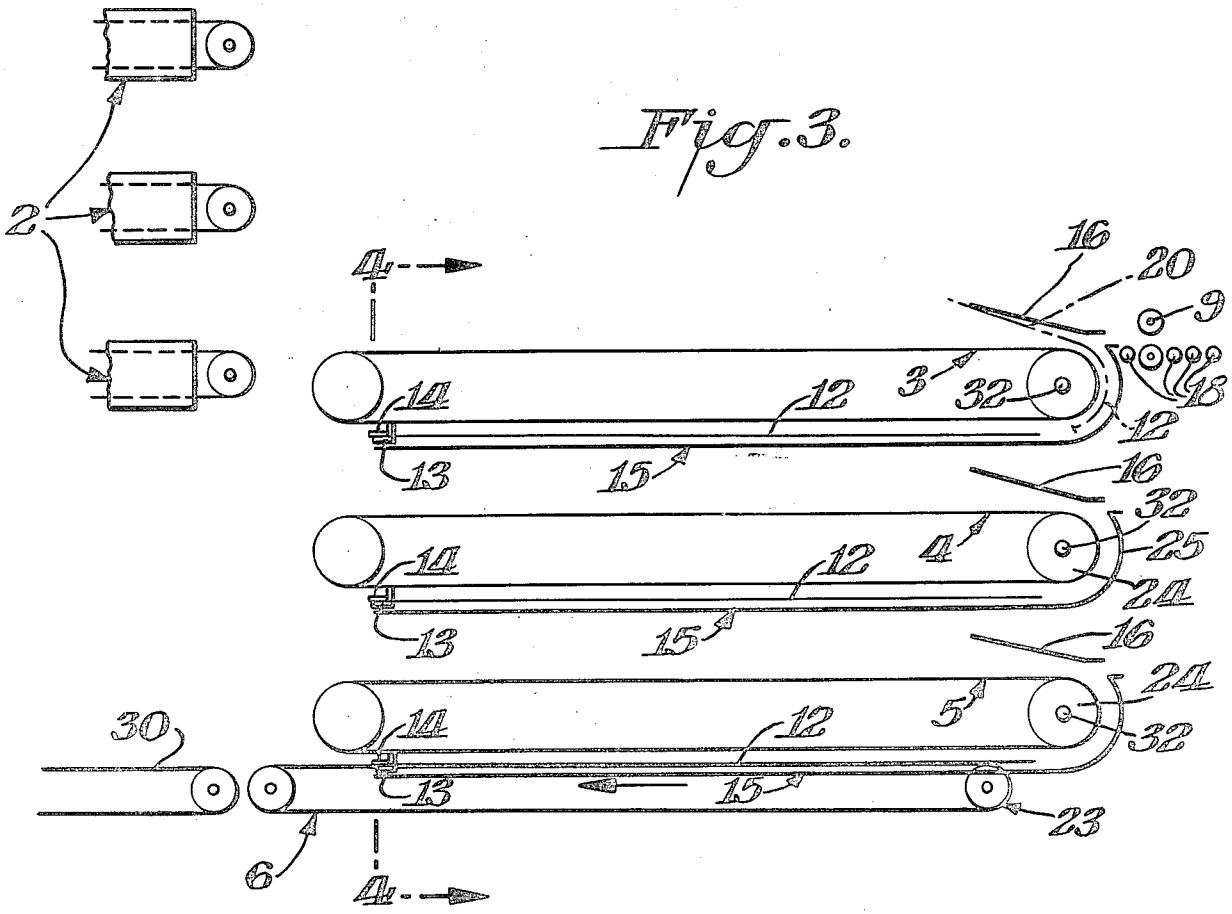
FIG. 3 is a schematic side elevational view of the installation of FIG. 1 in still another position of the operational sequence.

FIG. 3 clarifies the return transport of the flexible press trays 12 after emptying of the press unloader cage 1. The flexible press tray 12 resting on the auxiliary deck pair 15 of the lowest level is then in position for removal by the discharge device 6. The conveyor of the discharge device 6 is activated in the direction of the arrow by means of a drive motor (not shown). The conveyor being in contact with the flexible press tray 12 causes the tray to move to the left as viewed in FIG. 3 due to the frictional contact between the conveyor and the underside of the tray. Such movement of the press tray disconnects the head piece 14 from the carriers 13 of the chain conveyor pair 5. The press trays 12 of the middle and upper levels of the cage 1 are removed in similar fashion by lowering the cage onto the discharge device via the elevator 52. As schematically represented in FIGS. 1–3, the discharge device 6 delivers the flexible press trays 12 to a subsequent return transport belt 30 from which the flexible press trays are brought to a feed station (not shown) where each is filled with new particle material. Obviously, the tray on the discharge device is transported away before the next tray is lowered onto the device.

FIG. 4 shows a cross-section along the line 4—4 of FIG. 3 through the press unloader cage 1. The press unloader cage 1 is represented as an inverted U-shaped cage 26 open at the bottom and containing the chain conveyor pairs 3, 4, and 5 representing the three levels. Also, as shown in FIG. 4, the lower reach of each conveyor pair is slightly above the auxiliary deck pairs 15. This cross-section also includes the discharge device 6, which is placed on a base 17 supported by a foundation 18. When the press unloader cage 1 is lowered step-by-step, the discharge device 6 can ascend in relation to the descending press unloader cage, namely in the central opening 19, and can remove the individual flexible press trays 12. The discharge device 6 is preferably in the form of a conveyor belt. Depending upon the height of the base 17, removal of the flexible press trays 12 by the discharge device 6 can begin as early as when the first flexible press tray 12 rests upon the auxiliary deck pairs 15, and such an embodiment is shown in phantom outline in FIG. 2. Also, it is only necessary that the lowermost chain conveyor pair 5 has an auxiliary deck 15, and in such instances, the upper support decks 21 for the middle and uppermost chain conveyor pairs function as supports for the trays 12 immediately after their separation from the particle boards and prior to discharge of the trays.

The purpose of the representation by means of a phantom line in FIG. 3 of the end 20 of the flexible press tray 12, is to clarify how the guide 16, above each chain conveyor pair prevents this end from snapping upwardly. As shown in FIG. 4, decks 21 extend inwardly as do the auxiliary decks 15, but only over a limited portion of the total width of the press unloader cage 1. Hence, a central open area 19 is provided which allows relative vertical movement between the discharge device 6 and the press unloader cage 1. As can also be seen from FIG. 4, the chain conveyor pairs 3, 4, and 5 are located outside of the decks 21 and auxiliary decks 15. FIG. 4 clearly shows that the right-hand end 23 of the discharge device 6 ends short of the drive shafts 32 of the chain conveyor pairs 3, 4, and 5. Since these shafts extend over the full width of the press unloader cage, this relationship allows the relative vertical movement between the discharge device and the cage. Similarly the shafts of the chain conveyor pairs opposite shafts 32 are each stub shafts which allows the discharge device to enter into the central open area 19 for removal of the trays.

We claim:

1. A press unloading installation comprising a vertically movable inverted U-shaped press unloader cage with a central open area, the cage having multiple pairs of horizontally spaced apart conveyors with the conveyor pairs located one above the other each at a different cage level, spaced apart tray support means at each cage level adjacent each conveyor pair, means on the cagè for simultaniously feeding a pressed panel and its associated press tray partially into the cage at each cage level, means on each conveyor pair at each cage level connected to engage and shift the press tray and its associated panel completely into the cage and onto the tray support means, means for individually removing each panel from the cage and simultaneously separating the panel from its associated press tray where the conveyor pairs make a directional change while maintaining the tray with the conveyor pair and depositing the separated tray onto the tray support means, and discharge means moveable into the central open area of the inverted U-shaped cage for removing the separated press trays therefrom.

2. A press unloading installation according to claim 1 wherein the tray support means includes a support located directly below the lowermost conveyor pair for the separated press tray.

3. A press unloading installation according to any one of claim 1 or 2 wherein the discharge means is located directly below the cage for movement into the central open area thereof.

4. A press unloading installation according to claim 1 wherein the discharge means is located directly below the cage for movement into the central open area, and elevator means for vertically moving the unloader cage relative to the discharge means to remove separated press trays from the cage.

5. A press unloading installation according to any one of claims 1, 2 or 4 including a drum-like sheathing in the area of the directional change of each conveyor pair for guiding each press tray as it makes such directional change.

6. A press unloading installation according to any one of claims 1, 2 or 4 including a roller conveyor system for transporting the panel away from the cage upon its removal therefrom.

* * * * *